US006530481B1

(12) United States Patent
Bergdahl et al.

(10) Patent No.: US 6,530,481 B1
(45) Date of Patent: Mar. 11, 2003

(54) PRESSURE SCREEN WITH SCRAP SEPARATION

(75) Inventors: Anders Bergdahl, Sundsbruk (SE); Kjell Forslund, Sundsbruk (SE); Lennart Svensson, Sundsvall (SE); Björn Wikström, Valbo (SE)

(73) Assignee: Valmet Fibertech Aktiebolag (SE)

( * ) Notice: Subject to any disclaimer, the term of this patent is extended or adjusted under 35 U.S.C. 154(b) by 0 days.

(21) Appl. No.: 09/601,602

(22) PCT Filed: Feb. 2, 1999

(86) PCT No.: PCT/SE99/00132

§ 371 (c)(1),
(2), (4) Date: Sep. 20, 2000

(87) PCT Pub. No.: WO99/40253

PCT Pub. Date: Aug. 12, 1999

(30) Foreign Application Priority Data

Feb. 4, 1998 (SE) ..... 9800317

(51) Int. Cl.[7] ..... B03B 11/00; B03B 1/20; B03C 3/06

(52) U.S. Cl. ..... 209/17; 209/273; 209/284; 209/306; 209/725

(58) Field of Search ..... 209/17, 306, 273, 209/284, 725

(56) References Cited

U.S. PATENT DOCUMENTS

| | | | | | |
|---|---|---|---|---|---|
| 591,645 | A | * | 10/1897 | Baker et al. | 209/17 |
| 3,145,165 | A | * | 8/1964 | Sandison | 209/17 |
| 3,174,622 | A | * | 3/1965 | Lamort | 209/17 |
| RE25,774 | E | * | 5/1965 | Hukki | 209/17 |
| 3,255,883 | A | * | 6/1966 | Nelson et al. | 209/17 |
| 3,276,583 | A | * | 10/1966 | Carr | 209/17 |
| 3,363,759 | A | * | 1/1968 | Clarke-Pounder | 209/17 |
| 3,525,477 | A | * | 8/1970 | Kobayashi | 209/17 |
| 3,859,206 | A | * | 1/1975 | Baggaley | 209/17 |
| 3,905,894 | A | * | 9/1975 | Hukki | 209/17 |
| 3,964,996 | A | * | 6/1976 | Holz et al. | 209/17 |
| 4,043,919 | A | * | 8/1977 | Hutzler | 210/407 |
| 4,107,033 | A | * | 8/1978 | Holz | 209/17 |
| 4,151,083 | A | * | 4/1979 | Dove | 210/84 |
| 4,165,841 | A | * | 8/1979 | Musselmann et al. | 241/46.02 |
| 4,252,640 | A | | 2/1981 | Musselmann | 209/17 |
| 4,333,572 | A | * | 6/1982 | Frykhult | 209/17 |
| 4,334,986 | A | * | 6/1982 | Frykhult | 209/17 |
| 4,443,296 | A | * | 4/1984 | Lamort | 162/52 |
| 4,991,720 | A | * | 2/1991 | Hoglund et al. | 209/12 |
| 5,051,167 | A | * | 9/1991 | Hoglund | 209/270 |
| 5,078,275 | A | * | 1/1992 | Chupka et al. | 209/273 |
| 5,078,859 | A | * | 1/1992 | Satomi | 209/17 |
| 5,186,332 | A | * | 2/1993 | Hatton et al. | 209/17 |
| 5,435,444 | A | * | 7/1995 | Satomi | 209/234 |
| 5,899,338 | A | * | 5/1999 | Fredriksson | 209/17 |
| 6,131,742 | A | * | 10/2000 | Selin | 209/306 |

FOREIGN PATENT DOCUMENTS

| | | | | |
|---|---|---|---|---|
| DE | 1461090 | * | 10/1970 | 209/17 |
| SU | 1263373 | * | 10/1986 | 209/17 |
| SU | 1421421 | * | 9/1988 | 209/17 |
| WO | 94/16141 | | 7/1994 | |
| WO | 97/13918 | | 4/1997 | |

* cited by examiner

*Primary Examiner*—Donald P. Walsh
*Assistant Examiner*—Daniel Schlak
(74) *Attorney, Agent, or Firm*—Lerner, David, Littenberg, Krumholz & Mentlik, LLP

(57) ABSTRACT

A pressure screen for separating a liquid mixture is disclosed, comprising a screen housing forming a cylindrical screen chamber, and an inlet housing directly connected to the screen housing and forming a cylindrical inlet chamber, the diameter of which is less than the diameter of the screen chamber. An inlet member is positioned on the inlet chamber for supplying a suspension to be separated substantially tangentially into the inlet chamber and an outlet member is positioned on the inlet chamber for discharging coarse contaminants from the inlet chamber, whereby the scrap particles are prevented from entering the screen chamber.

8 Claims, 1 Drawing Sheet

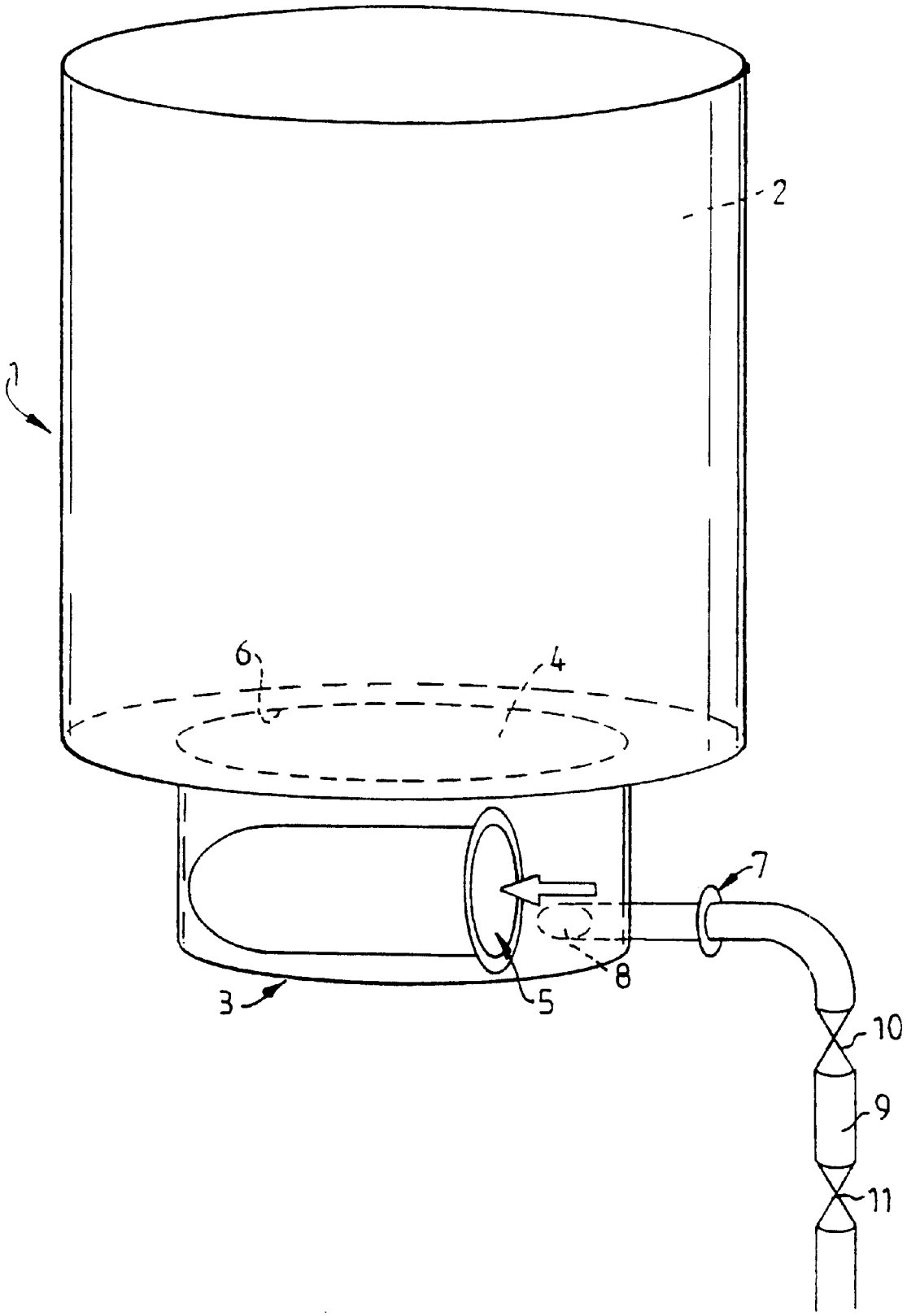
1
2
3
4
5
6
7
8
9
10
11

PRESSURE SCREEN WITH SCRAP SEPARATION

FIELD OF THE INVENTION

The present invention relates to a pressure screen for separating a liquid mixture containing undesired coarse contaminants, comprising a screen housing forming a cylindrical screen chamber, an inlet member for supplying the liquid mixture to be separated to the screen chamber, and at least one outlet member for discharging coarse contaminants from the pressure screen. In particular, the present invention relates to such a pressure screen designed for separating fiber suspensions, such as paper pulp suspensions. The coarse contaminants possibly occurring in such a suspension usually comprise scrap particles in the form of stone particles and metal pieces, which can damage and in the worst case cause breakdown of various elements located in the screen chamber, such as a rotor and/or a screen basket.

BACKGROUND OF THE INVENTION

In a traditional pressure screen with a rotor and a screen basket, the suspension is supplied through the inlet member tangentially into the cylindrical screen chamber to form a vortex. As a result, scrap particles rotating in the vortex are subjected to centrifugal forces that pull the scrap particles radially outwardly in the screen chamber, so that the scrap particles at best pass through the outlet member without interfering the rotor in the screen chamber. However, it has been proved that the velocity of the incoming fiber suspension into the screen chamber often is not sufficient to cause sufficient separation of all the scrap particles from the suspension to the outlet member. Therefore, the rotor and/or the screen basket often are damaged by heavy scrap particles, sometimes to such an extent that the pressure screen has to be taken out of order for repair.

A possible solution to the above problem of insufficient separation of scrap particles could be to increase the flow velocity of the fiber suspension to thereby increase the centrifugal forces acting on the scrap particles. However, this is not any practicable way, since a higher inlet velocity of the fiber suspension gives unacceptably high pressure losses across the screen and in addition a greater wear.

One object of the present invention is to provide an improved pressure screen having an efficient scrap separation property.

SUMMARY OF THE INVENTION

This and other objects are obtained by the pressure screen stated initially, which is characterized in that it further comprises an inlet housing forming a cylindrical inlet chamber having a diameter which is less than the diameter of the cylindrical screen chamber and being in fluid communication with the screen chamber. The inlet member is positioned on the inlet housing for supplying the liquid mixture substantially tangentially into the cylindrical inlet chamber and the outlet member is positioned on the inlet housing for discharging the coarse contaminants from the inlet chamber.

Since the incoming suspension will form a relatively narrow vortex in the cylindrical inlet chamber, the diameter of which is less than the diameter of the cylindrical screen chamber, heavier contaminants, such as scrap particles in the form of stone particles and metal pieces, will be subjected to stronger centrifugal forces that efficiently separate the scrap particles outwardly in the inlet chamber to the outlet member, so that the scrap particles are prevented from entering the screen chamber. As a result, the screen according to the present invention provides a safe pre-separation of scrap particles before the suspension is subjected to the main separation process in the screen chamber where a rotor and a screen basket normally are situated.

Preferably, the diameter of the cylindrical inlet chamber is at least 10% less than the diameter of the cylindrical screen chamber.

In an embodiment of the present invention, the cylindrical inlet chamber communicates with the cylindrical screen chamber by means of an axial passage between them, so that scrap particles rotating in the inlet chamber do not tend to enter the screen chamber. Preferably, the inlet housing is directly connected to the screen housing and situated below the screen housing, so that scrap particles in the inlet chamber are prevented by gravity from entering the screen chamber.

The axial passage may have a circular cross-section with the same diameter as the cylindrical inlet chamber and the cylindrical screen chamber may extend in parallel with the cylindrical inlet chamber, and preferably be coaxial thereto, which results in a simple design of the screen.

BRIEF DESCRIPTION OF THE DRAWING

An embodiment of the present invention will now be described in more detail with reference to the accompanying drawing in which the sole FIGURE schematically shows a perspective view of a pressure screen according to the invention.

DETAILED DESCRIPTION

The FIGURE shows a pressure screen comprising a cylindrical vertically oriented and fairly elongated screen housing 1 forming a cylindrical screen chamber 2, in which a rotor, not shown, is rotatably arranged and surrounded by a screen basket, not shown, for separating a fiber suspension into an accept fraction and a reject fraction. An inlet housing 3 directly connected to the screen housing 1 forms a cylindrical inlet chamber 4 and is situated below the screen housing 1. The cylindrical inlet chamber 4 is coaxial with the cylindrical screen chamber 2 and communicates axially with the latter by means of a passage 6. The passage 6 has a circular cross-section with the same diameter as the inlet chamber 4. Alternatively, the inlet chamber 4 and the screen chamber 2 may extend eccentrically relative to each other. As appears from the FIGURE the diameter of the inlet chamber 4 is considerably less than the diameter of the screen chamber 2, preferably at least 10% less.

An inlet member in the form of an inlet pipe 5 is positioned on the inlet housing 3 for supplying a fiber suspension to be separated tangentially into the inlet chamber 4. The inlet housing 3 is also provided with an outlet member in the form of an outlet pipe 7 extending substantially tangentially towards the cylindrical inlet chamber 4 and in the direction towards the incoming flow direction of the suspension, for discharging scrap particles, such as stone particles and metal pieces, existing in the fiber suspension. The outlet pipe 7 has an entrance opening 8 in the inlet chamber 4 situated approximately opposite the opening of the inlet pipe 5 in the inlet chamber 4.

A scrap accumulation chamber 9 is provided in the outlet pipe 7. An inlet valve 10 is situated in the outlet pipe 7 upstream of the accumulation chamber 9 and an outlet valve 11 is situated in the outlet pipe 7 below the accumulation chamber 9 and downstream thereof. During operation of the pressure screen, normally the valve 10 is open while the valve 11 is closed, so that scrap particles accumulate in the accumulation chamber 9. Periodically, the valve 10 is closed and the valve 11 is open so that scrap particles accumulated in the accumulation chamber 9 may be discharged by gravity.

While the invention advantageously may be implemented in the above described type of pressure screen that comprises a stationary screen basket and a rotor for generating pulses along the screen basket for counteracting clogging of the screen holes, the invention may also be implemented in other types of pressure screens that would benefit from pre-separation of scrap particles.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. A pressure screen separating a liquid mixture containing undesired coarse contaminants, comprising:

a screen housing forming a cylindrical screen chamber having a first diameter, an inlet housing directly connected to said screen housing and forming a cylindrical inlet chamber having a second diameter, said second diameter being less than said first diameter, an inlet member positioned on said inlet housing for supplying the liquid mixture to be separated substantially tangentially into said cylindrical inlet chamber, and at least one outlet member positioned on said inlet housing for discharging the coarse contaminants from said cylindrical inlet chamber, said cylindrical inlet chamber being in fluid communication with said screen chamber by means of an axial passage directly connecting said cylindrical inlet chamber with said screen chamber, said axial passage having a third diameter, said third diameter corresponding to said second diameter.

2. A pressure screen according to claim 1, wherein said inlet housing is situated below said screen housing.

3. A pressure screen according to claim 1, wherein said cylindrical screen chamber extends in parallel with said cylindrical inlet chamber.

4. A pressure screen according to claim 1, wherein the diameter of said cylindrical inlet chamber is at least 10% smaller than that of said cylindrical screen chamber.

5. A pressure screen according to claim 1 wherein said inlet housing comprises a cylindrical wall and said at least one outlet member is positioned on said cylindrical wall of said inlet housing.

6. A pressure screen according to claim 5 wherein said at least one outlet member comprises a pipe extending substantially tangentially towards said cylindrical inlet chamber.

7. A pressure screen according to claim 6 wherein said pipe extends substantially tangentially towards said cylindrical inlet chamber in a first direction and wherein said inlet member extends substantially tangentially towards said cylindrical inlet chamber in a second direction, said second direction being opposite from said first direction.

8. A pressure screen according to claim 7 wherein said inlet member forms an opening in said cylindrical inlet chamber and said pipe forms an entrance opening in said cylindrical inlet chamber situated approximately opposite said opening formed in said inlet member.

* * * * *